United States Patent [19]

Hess et al.

[11] 3,944,462

[45]*Mar. 16, 1976

[54] COKING OF WASTE KRAFT PULPING LIQUORS AT LOWERED PH

[75] Inventors: Howard V. Hess, Glenham; Edward L. Cole, Fishkill; William F. Franz, Gardiner, all of N.Y.

[73] Assignee: Texaco Inc., New York, N.Y.

[ * ] Notice: The portion of the term of this patent subsequent to Sept. 17, 1991, has been disclaimed.

[22] Filed: Aug. 1, 1973

[21] Appl. No.: 384,672

Related U.S. Application Data

[63] Continuation-in-part of Ser. No. 149,672, June 3, 1971, abandoned.

[52] U.S. Cl. ..... 162/31; 423/207

[51] Int. Cl.[2] ..... D21C 11/14

[58] Field of Search ..... 162/30, 31, 32, 36, 47; 210/21, 56, 63, 71; 201/25; 423/207, 461

[56] References Cited

UNITED STATES PATENTS

| | | | |
|---|---|---|---|
| 2,752,243 | 6/1956 | Barton et al. | 162/31 |
| 3,272,739 | 9/1966 | Earle et al. | 210/71 X |
| 3,595,806 | 7/1971 | Prahacs et al. | 23/48 X |
| 3,607,619 | 9/1971 | Hess et al. | 162/30 |
| 3,649,534 | 3/1972 | Schotte | 210/63 |
| 3,654,071 | 4/1972 | Brannland et al. | 23/48 X |
| 3,717,545 | 2/1973 | Hess et al. | 162/36 X |
| 3,836,427 | 9/1974 | Cole et al. | 162/31 |

*Primary Examiner*—S. Leon Bashore
*Assistant Examiner*—William F. Smith
*Attorney, Agent, or Firm*—T. H. Whaley; C. G. Ries; Henry W. Archer

[57] ABSTRACT

The liquid phase coking of waste kraft pulping liquors can be effected with a shorter residence time in the coking means at lower temperature, and lower pressure by reducing the pH of such liquors by at least one pH unit before coking. Products are lower in malodorous organic sulfur components than those produced at a higher pH.

The lowering of the pH is achieved by adding sulfur dioxide to the liquor either as free $SO_2$ or as an aqueous solution of $SO_2$.

8 Claims, 4 Drawing Figures

COKING OF WASTE KRAFT PULPING LIQUORS AT LOWERED PH

CROSS REFERENCE TO CO-PENDING APPLICATION

Figure 1:
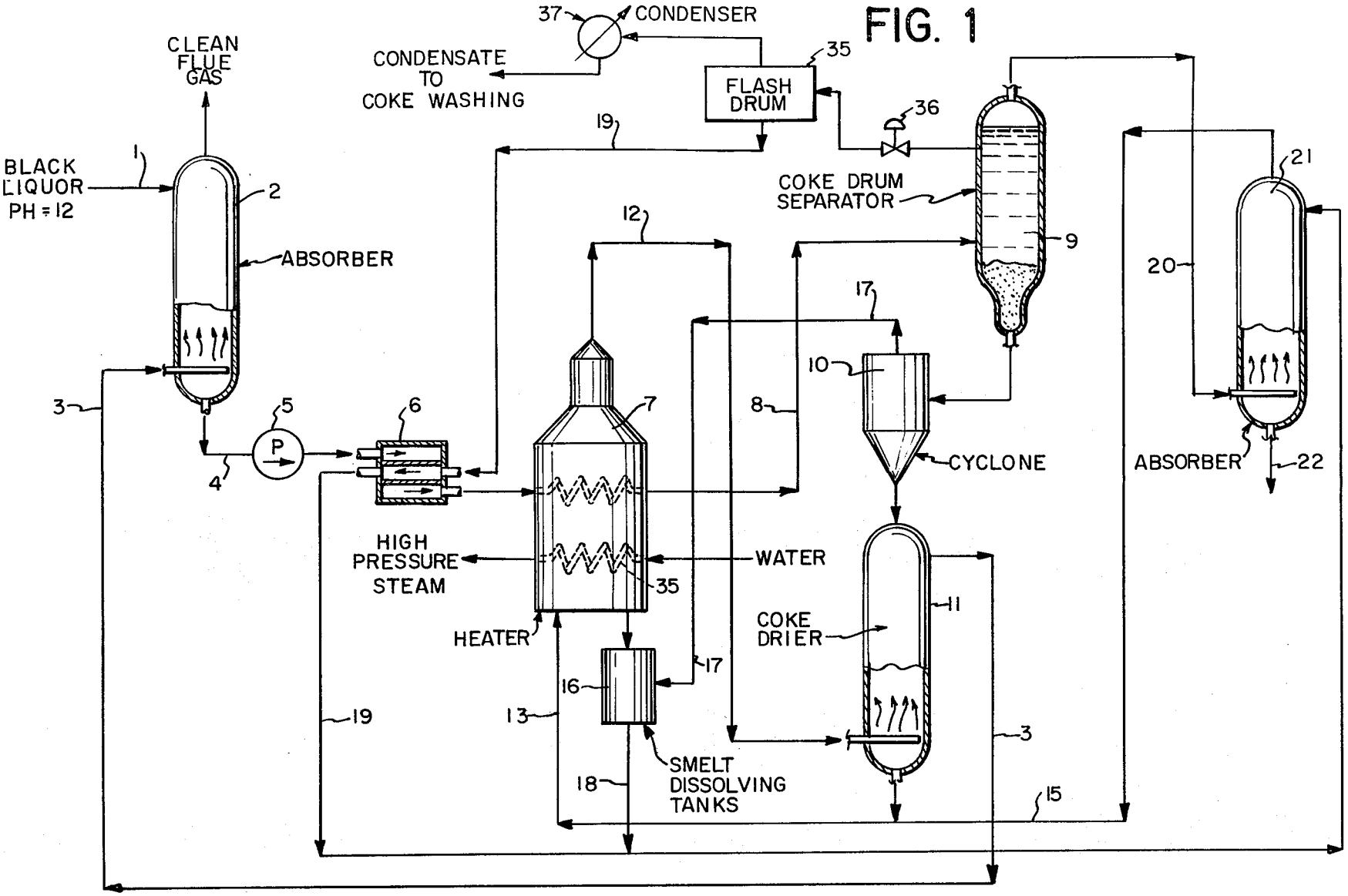

This application is a continuation-in-part of coassigned U.S. Pat. application Ser. No. 149,672 filed June 3, 1971 and now abandoned.

BACKGROUND OF THE INVENTION

Field of the Invention

The present invention is concerned with coking waste kraft pulping process liquors containing organic matter dissolved from wood.

SUMMARY OF THE INVENTION

In accordance with the present invention spent alkaline Kraft pulping liquors are flowed to an absorbing zone and extraneous sulfur dioxide is added thereto to lower the pH of the liquors by at least one unit and preferably down to 2–7 prior to coking them in the liquid phase in the absence of air under autogenous pressure in a coking zone thereby forming coke, gases including $H_2S$ and an aqueous effluent. The coke is separated from the effluent in a separating zone and burned to produce the above-mentioned sulfur dioxide. Lime and $H_2S$ are added to this effluent in a second absorbing zone to reconstitute Kraft cooking liquor.

In the drawing

Figure 2:
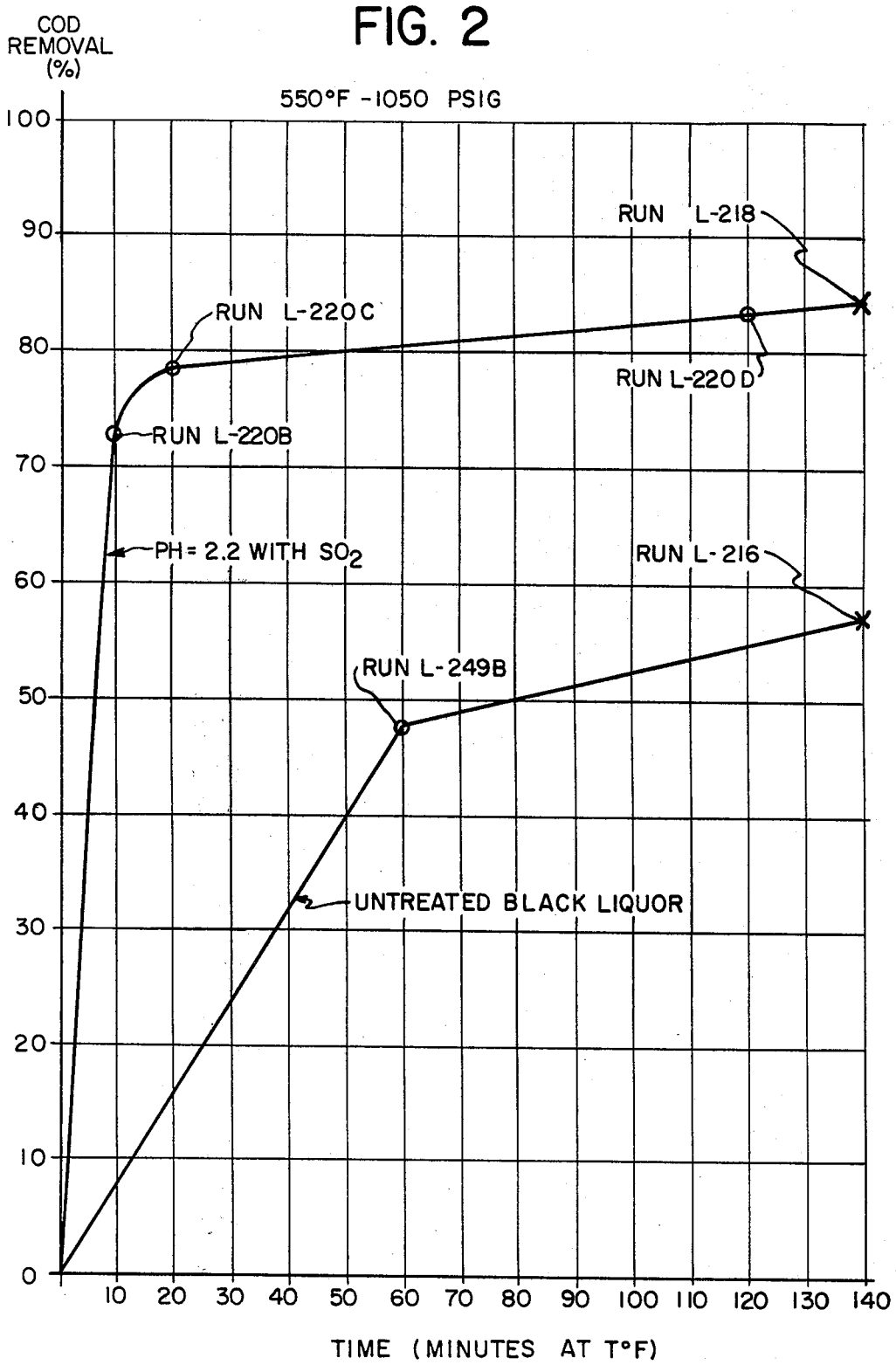
Figure 4:
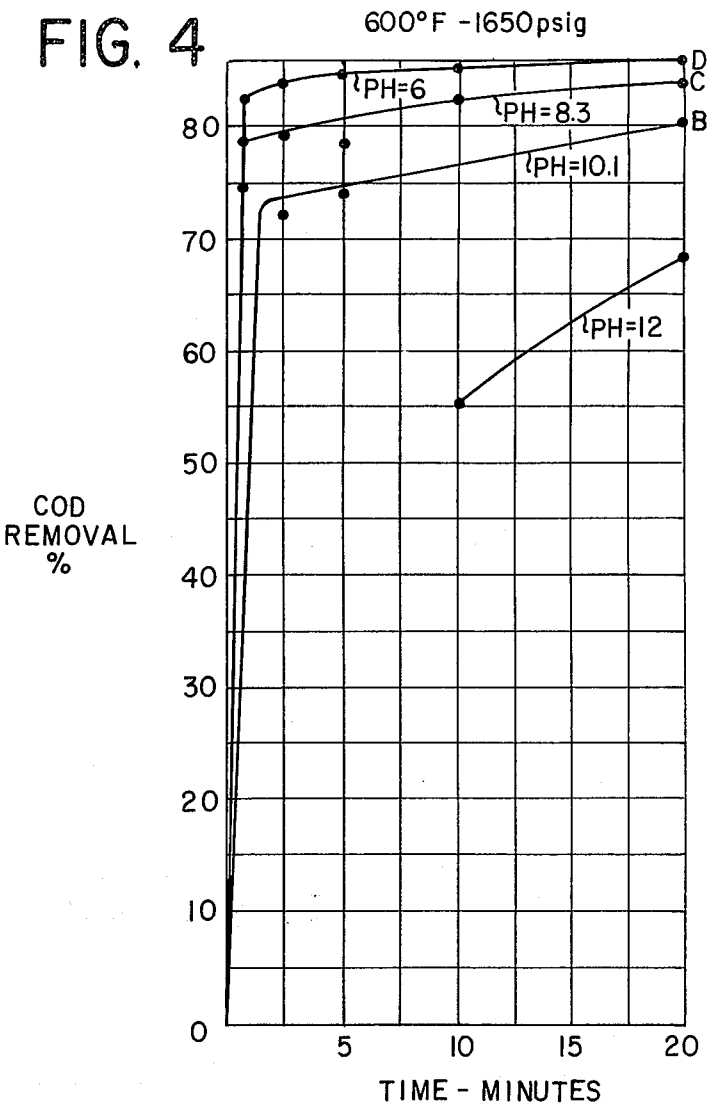
Figure 3:
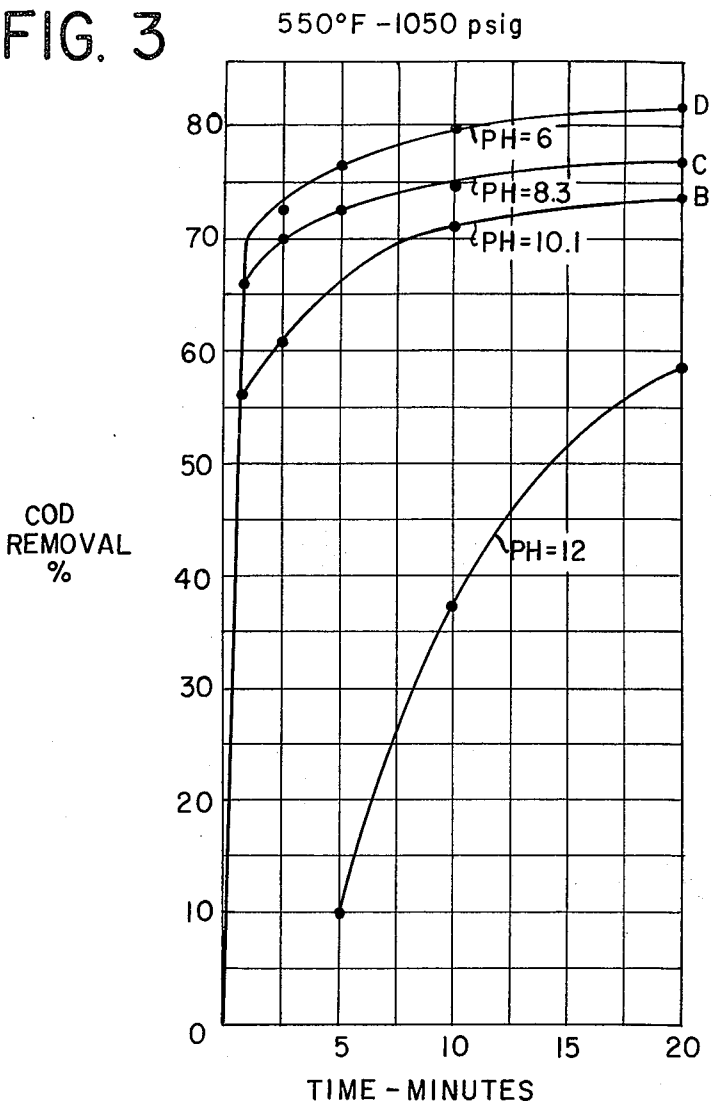

FIG. 1 shows one installation in which the process of the invention can be carried out and FIGS. 2, 3 and 4 are graphs showing the influence of time on COD reduction for alkaline and acid spent Kraft liquors.

As shown in FIG. 1, Black liquor from a Kraft pulping mill has a pH of about 12 (before oxidation) and is passed through line 1 to absorber tower 2 wherein it is contacted with $SO_2$-containing flue gas from line 3. In the absorber tower 2, $SO_2$ is absorbed in the Black Liquor and the pH is dropped to as low as 2. This low pH liquor then passes through line 4 to pump 5 where it is pumped up to pressure, say 1100 psig, and thence through heat exchanger 6 where it is in heat exchange with liquid coker effluent from coke drum 9 through line 19. After heat exchange, the low pH black liquor passes through the upper part of fired heater 7 wherein the temperature is raised to about 550°F. and then through line 8 to separator (or coke drum) 9. In the separator 9, the coke settles and is withdrawn to cyclone 10 which serves to further dewater the coke before passing it to the coke drier 11. In the drier 11 the coke is contacted with hot flue gases (containing $SO_2$) produced in the heater 7 and passing through 12 which dries the coke. The dry coke, optionally with some of the produced gases from line 15, is burned in the heater 7 to produce high pressure steam in the bottom part of the heater and to supply heat for coking the Black Liquor in the top part of the heater. The hot combustion gases produced in the heater 7 pass through line 12 and are utilized for drying the coke in vessel 11. The cooled combustion gases (containing $SO_2$ produced by burning the sulfur-containing coke and, optionally part, of the sulfur bearing gas from line 15) pass through line 3 to absorber 2 where the $SO_2$ is scrubbed out and the pH of the Black Liquor charge is reduced. Also shown in the heater is a loop 35 for preparing high pressure process steam. If there is any smelt produced in the heater 7 it is discharged to smelt dissolving tank 16 where it is contacted and dissolved smelt is combined with the cooled liquid effluent from the coker passing along line 19 through heat exchanger 6. The liquid in line 19 now is a mixture of liquid coker effluent and dissolved smelt, and will contain sodium sulfide, sodium carbonate, and sodium hydroxide (and, occasionally, small amounts of sodium sulfate and sodium thiosulfate). This will be causticized by treating the lime and then contacted with $H_2S$-bearing gas from line 20 in absorber 21 where the caustic liquor would be brought up to proper sulphidity by absorption of $H_2S$. Fortified wood pulping liquor suitable for wood pulping passes through line 22 to the digester of a wood pulping plant. The scrubbed gas leaving absorber 21 passes through line 15 and eventually is burned in the coke burning heater 7.

Many variations of the above flow scheme can be drawn. One modification is that the liquid coker effluent from separator 9 at 550°F. and 1100 psig can be flashed in flash drum 35 by depressurizing with throttle valve 36 to produce water free from salts in condenser 37. This flashed water then can be used to wash sodium salts from the wet coke before it passes to the coke drier 11. This reduces the amount of sodium compounds burned along with the coke in the heater 7 and substantially or completely reduce the production of smelt from the furnace 7. Also heater 7 can be of a type which provides rapid heating of the liquors at the rate of about 110° to about 150°F. per minute in the temperature interval of 350° to about 550°F. to prevent formation of coke gels.

The examples and the data appearing below show that the pH adjustment allows for a much greater reduction in COD (Chemical Oxygen Demand) in a much shorter residence time. This residence time is important since it cuts down the time necessary to hold the hot coker liquid in the pressure coke drum and thus offers a substantial savings in the equipment required. It is also apparent that the composition of the gases produced is markedly different, most of the sulfur in the gas appearing as hydrogen sulfide rather than as organic sulfur compounds. The gases are also considerably richer in carbon dioxide.

Referring to Table I and Run L-216: this run shows coking of the Black Liquor as received without any adjustment of pH by blowing with $SO_2$. It can be seen that coking at 550°F. for 2 hours shows a reduction in COD of 56%. The gases produced are very high in organic sulfur compounds, dimethyl sulfide and methyl mercaptan and low in $H_2S$ and $CO_2$. A washed coke yield of 3.1% was obtained. A reduction of carbon in the waste liquor from 6.8% of 3.9% or 43% was obtained.

Referring to Table II and to Run L-218: the pH of the Black liquor here was reduced from 12.1 to 2.2 by blowing the waste liquor with $SO_2$. This liquor was then coked at autogeneous pressure and 550°F. for 2 hours and produced a coker effluent with the COD reduced by 83.6%. The carbon was reduced from 6.8% to 0.9%, a reduction of 86.8%. The gases produced were largely $H_2S$ and $CO_2$ with minor amounts of dimethyl sulfide and methyl mercaptan. A washed coke yield of 7.8% was obtained.

Both of the above runs also show the principle of coke washing for removal of sodium. Coke-filtering and coke washing are easier with the coke produced from Run L-218 than with that of L-216. In general when coking Kraft Black Liquors (without pH adjustment) it was found that the cokes are difficult to wash and filter. When the liquors are treated with $SO_2$ to pH 2.2 they are readily filtered and washed. As regards coke washing in Run L-216: one-half of the wet coke produced (23g) was slurried in a breaker with 200 ml. water, vacuum filtered and washed on the filter with 800 ml. water and dried. The unwashed dry coke contained 6.1 wt.% of sodium; the washed dry coke contained 3.3 wt.% of sodium, showing that the washing procedure removed 46% of the sodium. In Run L-218: one-half of the wet coke produced (37g) was washed as above. The unwashed dry coke contained 2.0 wt.%, the washed dry coke contained 0.22% sodium, showing that the washing procedure removed 89% of the sodium as regards filtering characteristics.

The following runs were carried out in stainless steel tubes heated in a metal bath to 550°F. Sixty grams of liquor was charged to each of the tubes and they were sealed. The tubes were heated for the times shown in the metal bath and then quenched in air to ambient temperature and the produced gas was vented. The liquids plus solids were then filtered under the same conditions and a yield of wet coke and filtrate were obtained. The wet coke was dried on a steam plate to give a dry coke yield. The filtrates were analysed for COD. For comparative purposes yields were adjusted to 100%. Also in the adjusted dry coke yield the amount of solids from the filtrate liquid adhering to the wet coke was calculated and this amount was subtracted from the dried wet coke yield. This adjusted coke yield, then, is the true coke yield after having corrected for the solids retained on the coke during the drying operation.

In Table III, Run L-71-6 shows coking of black liquor at a pH of 4.8, the initial pH having been 8.7. Coking was carried out at 550°F. under 1075 pounds pressure for two hours and produced a coker effluent having a COD of 30.4 g/l as compared with starting liquor. A washed coke yield of 5.9% was obtained and this coke had a gross heat of combustion of 11,831 BTU/lb.

In Table IV, Run L-249B was the Black Liquor without any pH adjustment. Runs L-220 B, C and D were carried out on Black Liquor with the pH adjusted to 2.2 by blowing with $SO_2$ at atmospheric pressure.

It can readily be seen that the Black Liquors adjusted to the low pH coked more readily than the untreated Black Liquor as evidenced by the coking time and the COD removal. There is a substantial improvement in filtering time, as shown. It should be noted also that the filtrate liquor hold up on the wet coke is considerably less when coking the low pH material. Examination of the coke yields adjusted for the dissolved solids in the filtrate liquor adhering to the wet coke shows the adjusted coke yields to be in line with the COD removal.

The curves plotted on FIG. 2 serve to show the influence of time on COD reduction when coking the straight Black Liquor and Black Liquor adjusted to pH 2.2. It is quite evident from the curves that coking at the low pH allows for greater COD removal in less time.

TABLE I

RUN L-216
BLACK KRAFT LIQUOR BEFORE OXIDATION

| | Yield Wt.% | Wt.% Dissolved Solids | COD g/l | Wt.% Ash | Wt.% C | Wt.% Sulfur | Wt.% Na | Ca | Wt.% N | Wt.% $H_2$ | pH | Gross Heat of Combustion BTU/lb. |
|---|---|---|---|---|---|---|---|---|---|---|---|---|
| Spent Liquor | | 22.0 | 195.6 | 14.40 | 6.8 | 0.84 | 4.3 | 0.037 | 0.007 | | 12.1 | |
| Effluent from Coker | 88.2 | 14.8 | 85.9 | 3.81 | 3.9 | 0.67 | 4.4 | 0.032 | 0.007 | | 9.9 | |
| Wet Coke | 9.2 | (50% $H_2O$) | | | | | | | | | | |
| Coke (Dry) | 4.6 | | | 12.94 | 62.9 | 1.62 | 6.1 | 0.071 | | 4.8 | | 11,587 |
| Dry Washed Coke | 3.12 | | | 8.41 | 66.0 | 2.07 | 3.3 | 0.060 | | 4.9 | | 12,439 |
| Gas | 0.53 | Mol % | | | 34.6 | 48.0 | | | | | | |
| Dimethyl Sulfide | | 38.7 | | | | | | | | | | |
| Methyl mercaptan | | 18.0 | | | | | | | | | | |
| Carbon dioxide | | 8.75 | MW=38.8 | | | | | | | | | |
| Hydrogen Sulfide | | 1.45 | | | | | | | | | | |
| Ethane | | 1.0 | | | | | | | | | | |
| Methane | | 6.1 | | | | | | | | | | |
| Hydrogen | | 26.0 | | | | | | | | | | |

TABLE II

RUN L-218
BLACK KRAFT LIQUOR BEFORE OXIDATION

| | Yield Wt. % | Wt.% Dissolved Solids | COD g/l | Wt.% Ash | Wt.% C | Wt.% Sulfur | Wt.% Na | Ca | Wt.% N | Wt.% $H_2$ | pH | Gross Heat of Combustion BTU/lb. |
|---|---|---|---|---|---|---|---|---|---|---|---|---|
| Spent Liquor | | 22.0 | 195.6 | 14.40 | 6.8 | 0.84 | 4.3 | 0.037 | 0.007 | | 12.1 | |
| Blow with $SO_2$ | 108.6 | | | | | | | | | | 2.2 | |
| Effluent from coker | 76.6 | 17.4 | 32.0 | 14.3 | 0.9 | 3.6 | 4.1 | 0.030 | | | 2.5 | |
| Wet Coke | 14.8 | (53% $H_2O$) | | | | | | | | | | |
| Coke (Dry) | 7.82 | | | 22.63 | 50.2 | 19.5 | 2.0 | 0.054 | | 2.6 | | 10,106 |
| Dry Washed Coke | 7.8 | | | 13.73 | 51.2 | 15.6 | 0.22 | 0.054 | | 3.0 | | 10,368 |
| Gas | 4.2 | Mol% | | | 18.0 | 34.3 | | | | | | |
| Thiophene | | 0.1 | | | | | | | | | | |
| Dimethyl Sulfide | | 0.2 | | | | | | | | | | |
| Methyl Mercaptan | | 2.86 | | | | | | | | | | |
| Carbon Dioxide | | 54.2 | MW=38.6 | | | | | | | | | |
| Hydrogen Sulfide | | 38.3 | | | | | | | | | | |
| Methane | | 0.2 | | | | | | | | | | |
| Hydrogen | | 4.1 | | | | | | | | | | |

TABLE III

Run L-71-6
Black Liquor Before Oxidation

| | Yield Wt. % | Wt. % Dissolved Solids | COD g/l | Wt % Ash | Wt % C | Wt % Sulfur | Wt % Na | Ca | Wt % N | Wt % $H_2$ | pH | Gross Heat of Combustion BTU/lb. |
|---|---|---|---|---|---|---|---|---|---|---|---|---|
| Spent Liquor | | 22.0 | 195.6 | 14.4 | 6.8 | 0.84 | 4.3 | 0.037 | 0.007 | | 12.1 | |
| Blow with $SO_2$ | | | | | | | | | | | 4.8 | |
| Effluent From Coker | 77.4 | 15.4 | 30.4 | 10.64 | 1.4 | 2.68 | 4.5 | 0.004 | | | 8.7 | |
| Wet Coke | 14.6 | (46.5% $H_2O$) | | | | | | | | | | |
| Coke (dried) | 7.8 | | | 17.0 | 58.2 | 14.4 | 5.1 | 0.03 | | 2.6 | | 10,480 |
| Coke (washed) | 5.9 | | | 5.5 | 67.8 | 14.0 | 1.0 | 0.04 | | 3.0 | | 11,831 |
| Gas | 2.8 | Mol % | | | 25.1 | 28.7 | | | | | | |
| | | Dimethyl Sulfide | 0.5 | | | | | | | | | |
| | | Methyl Mercaptan | 2.21 | | | | | | | | | |
| | | Carbon Dioxide | 61.0 | MW=39.5 | | | | | | | | |
| | | Hydrogen Sulfide | 32.5 | | | | | | | | | |
| | | Methane | 0.7 | | | | | | | | | |
| | | Hydrogen | 3.0 | | | | | | | | | |

TABLE IV

| Run Number | pH | Coking Time Minutes | Filtering Time Seconds | Filtrate Yield wt.% | Yield wt.% | Wet Coke Wt.% Filtrate Liquor | Dried Wet Coke Yield Wt.% | Adjusted Dry Coke Yield Wt.% | COD Removal Wt.% |
|---|---|---|---|---|---|---|---|---|---|
| L-249B | 12.1 | 60 | 165 | 84.0 | 16.0 | 70.6 | 4.68 | 3.0 | 47 |
| L-220B | 2.2 | 10 | 30 | 93.0 | 7.0 | 34.0 | 4.12 | 3.7 | 73 |
| L-220C | 2.2 | 20 | 30 | 87.3 | 12.7 | 46.0 | 7.06 | 6.0 | 79 |
| L-220D | 2.2 | 120 | 20 | 88.5 | 11.5 | 35.7 | 6.86 | 6.1 | 80 |

The curves of FIGS. 3 and 4 demonstrate the effect of $SO_2$ addition (as measured by pH reduction) for coking a spent Kraft Pulping liquor (produced from pulping southern pine wood) at 550° and 600°F. This spent Kraft liquor had been concentrated by distillation so that the Tall Oil could be recovered and the resulting waste liquor had a very high COD (288g. $O_2$ per liter) and a pH of 12.

On the two figures:

Curve A — Kraft liquor as received, pH 12

Curve B — Kraft liquor with pH adjusted to 10.1 pH by $SO_2$ addition

Curve C — Kraft liquor with pH adjusted to 8.3 pH by $SO_2$ addition

Curve D — Kraft liquor with pH adjusted to 6 pH by $SO_2$ addition

By examination of the figures the following conclusions may be drawn:

1. Reduction of pH with $SO_2$ causes a remarkable acceleration of the coking reaction and drives it towards completion as evidenced by COD removal.

2. It is not necessary to reduce the pH to below 7 (acid side) to obtain better coking results although the lower the pH, the better the results for the coking reaction.

3. When the pH is adjusted to below 7, the coking results are better than when the pH is still adjusted with $SO_2$ but remains above 7.

4. It becomes apparent that the residence time for the coking reaction to go well towards completion is only of the order of one minute if carried out at 600°F. This allows the whole coking reaction to take place in the heater coil itself rather than having to supply a high pressure coke drum to supply extra residence time. Thus a 600°F. operating temperature is better than the 550°F. operating temperature.

Although preferred embodiments only of the invention have been given, it is to be understood that the invention is not limited thereto but may be otherwise embodied or practised within the scope of the following claims.

What is claimed is:

1. In combination in a process for treating alkaline Kraft pulping liquors, the steps of: flowing said liquors to an adsorbing zone and adding extraneous $SO_2$ to said liquors in said zone to lower the pH thereof by at least one unit then coking said liquors in the liquid phase in the absence of air in a coking zone by heating to a temperature in the range of 450° to 700°F. under a pressure of about 1000 to about 3000 psig for 0.5 minutes to 6 hours thereby forming coke, gases including $H_2S$ and an aqueous effluent; separating in a separating zone said coke from said effluent; burning said coke to produce said sulfur dioxide; adding lime and said $H_2S$ to said effluent in a second absorbing zone to form new Kraft cooking liquor.

2. The process according to claim 1 wherein scrubbed gas leaving said second absorbing zone is combined with gas collected in said separating zone.

3. The process according to claim 1 wherein the pH of the liquor is brought down to between 2 and 7 before coking.

4. The process according to claim 1 wherein said coke is washed to remove sodium salts therefrom.

5. The process according to claim 1 wherein said liquors after pH reduction are preheated by heat exchange with hot effluent from said separating zone.

6. The process according to claim 1 wherein said gases produced by burning said coke and said coke are placed in contact in a drying zone to dry said coke prior to contacting said liquors to acidify same.

7. The process according to claim 5 wherein smelt is produced by burning said coke; said smelt is combined with effluent cooled by said heat exchange to form a liquid containing sodium sulfide, sodium carbonate and sodium hydroxide and said liquid is made basic with lime and process $H_2S$ is added to form new Kraft cooking liquor.

8. The process according to claim 1 wherein said aqueous effluent is removed from said separation zone and flashed to produce salt-free water.

* * * * *